United States Patent [19]

Yackiw

[11] Patent Number: 4,656,785

[45] Date of Patent: Apr. 14, 1987

[54] WEATHERSEAL

[75] Inventor: Charles Yackiw, Fairport, N.Y.

[73] Assignee: Schlegel Corporation, Rochester, N.Y.

[21] Appl. No.: 851,122

[22] Filed: Apr. 11, 1986

[51] Int. Cl.[4] ..... E06B 7/16

[52] U.S. Cl. ..... 49/495; 49/485; 49/489

[58] Field of Search ..... 49/489, 495, 485, 475, 49/440, 441

[56] References Cited

U.S. PATENT DOCUMENTS

| | | | |
|---|---|---|---|
| 2,172,091 | 9/1939 | Scott | 49/489 |
| 3,359,686 | 12/1967 | Kondolf | 49/475 X |
| 3,469,349 | 9/1969 | Multer | 49/489 X |
| 4,185,416 | 1/1980 | Wilmes | 49/495 X |
| 4,497,137 | 2/1985 | Nelson | 49/495 X |

*Primary Examiner*—Philip C. Kannan
*Attorney, Agent, or Firm*—Cumpston & Shaw

[57] ABSTRACT

An elongate weatherseal is disclosed for installation in a right angled recess in a door frame or the like. The weatherseal comprises, in its manufactured state, a flat, rigid, plastic base member having side edge portions and a central portion. A rigid attachment member depends from one side of the base member. A pair of legs formed from a soft resilient material are secured to the side edge portions of the base member, and extend outwardly toward one-another from the opposite side of the base member. The weatherseal further has a hinge notch on one side of the base member substantially at the junction of the base member and attachment member to facilitate bending the weatherseal 90° during installation thereof into the door recess.

7 Claims, 6 Drawing Figures

WEATHERSEAL

BACKGROUND OF THE INVENTION

1. Field of the Invention

This invention relates generally to seals, and more specifically to a weatherseal for door frames or the like.

2. Description of the Prior Art

A known type of seal disclosed in U.S. Pat. No. 4,328,283, and British Pat. Nos. 1,467,534 and 1,507,071 comprises a polymeric resilient foam core covered by a thin film of polymeric material.

U.S. Pat. No. 3,761,347 discloses a pressure-sensitive weatherseal for a door or the like that engages the door in a compressive seal along one edge, and a wiping or sliding seal along another edge.

U.S. Pat. No. 4,185,416 discloses a weatherstrip for sealing the meeting stiles of a sliding door unit. The weatherstrip comprises two elongate weatherstrip members, each member having a rigid base section fixedly secured to a stile. Each weatherstrip member further has a first flexible leg extending from the base section at an angle thereto to resiliently engage a corresponding leg on the other weatherstrip member, and a second resilient leg for sealing against the side of a stile.

Unitary elastomeric weatherseals of the type having a base member and a pair of flexible legs extending outwardly therefrom are shown in German Pat. No. 634,860 and Japanese Publication Sho-44-2033.

SUMMARY OF THE INVENTION

In accordance with a preferred embodiment of the invention, a weatherseal is disclosed for sealing the perimeter of a door or the like in a right angled recess in a door frame along at least the top and vertical sides thereof. The weatherseal in its manufactured state comprises an elongate, flat, substantially rigid plastic base member having side edge portions and a central portion. Means are provided for securing one side of the base member of the weatherseal in the door recess. The weatherseal further has a pair of legs formed from a soft resilient material. Each leg has one end secured to the opposite side of the base member at one of the side edge portions. The legs have necked-down portions adjacent the base member about which the legs are pivotal. The free ends of the legs comprise flat portions that extend outwardly transversely of the base member toward one another at angles $\alpha$ and $\beta$ of around 35° and 55° respectively. The base member further has an elongated hinge notch on a side surface of the base member intermediate the ends thereof. The hinge notch facilities bending the weatherseal into a 90° angle configuration for installation of the weatherseal in the right angled recess in the door frame.

In a more specific aspect of the invention, the legs are formed of a polyurethane foam material, and are each covered by a layer of polyethylene material.

In a more specific aspect of the invention, the weatherseal is used to seal a door to a wood frame of the type having a wood stile and an exterior steel panel. The means for securing the weatherseal to the door comprises an attachment member depending from the side surface of the base member. The weatherseal is bent into a 90° configuration and the attachment member thereof inserted into a kerf in the wood frame for securing the weatherseal in the right angled recess in the door frame. When the door is moved into its closed position, the top and sides of the steel panel and a conventional finned weatherstrip on the bottom of the door sealingly engage the legs along surfaces to prevent exterior cold air from passing between the wood frame and door perimeter. The wood stile also sealingly engages one of the legs along a surface to prevent interior warm air from passing between the wood stile and wood frame into engagement with and condensing on the edges of the cold steel panel.

One of the primary advantages of the weatherseal of this invention is to provide an improved seal, particularly for doors having an exterior steel panel. One leg of the weatherseal seals the door and steel panel along at least one surface to prevent warm room interior air from engaging the cold steel panel and condensing. Such condensation, if not prevented, would cause the steel panel to rust and the wood in the door and frame to deteriorate. Both legs seal the door along surfaces to prevent cold exterior air from passing the door into the adjacent warm room. The one leg further specifically prevents exterior air from leaking around the bottom corners of the door and past the ends of a conventional weatherstrip secured to the bottom side of the door and into the room.

Another advantage of the weatherseal of this invention is to provide a weatherseal having a compressible seal leg between the steel panel and door stop to allow bowing of the door when the steel panel is subjected to sub-zero temperature. Without such compressibility, the bowing could cause the door lock bolt to bind in the strike plate making opening of the door difficult. In extreme cases, the bowing can cause the bolt to rip out the strike plate. The invention and its advantages will become more apparent from the detailed description of the invention presented below.

BRIEF DESCRIPTION OF THE DRAWINGS

In the detailed description of the invention presented below, reference is made to the accompanying drawings, in which.

DETAILED DESCRIPTION OF THE INVENTION

Figure 1:
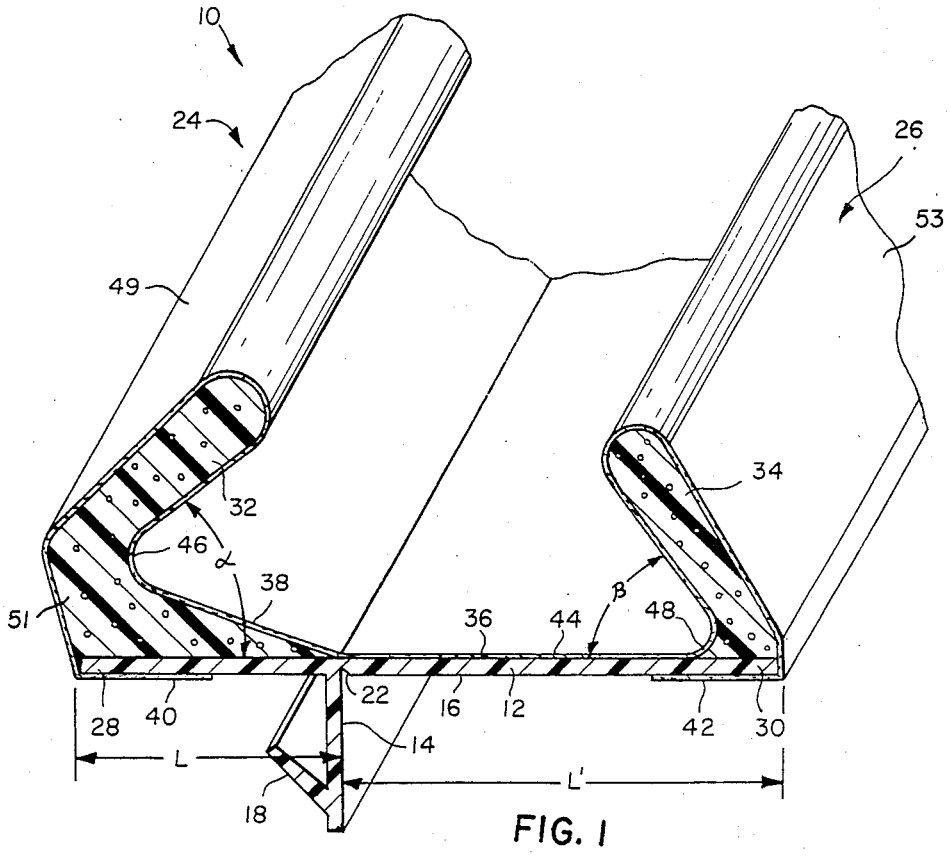
FIG. 1 is a perspective view of a preferred embodiment of the elongate weatherseal of this invention.
Figure 2:
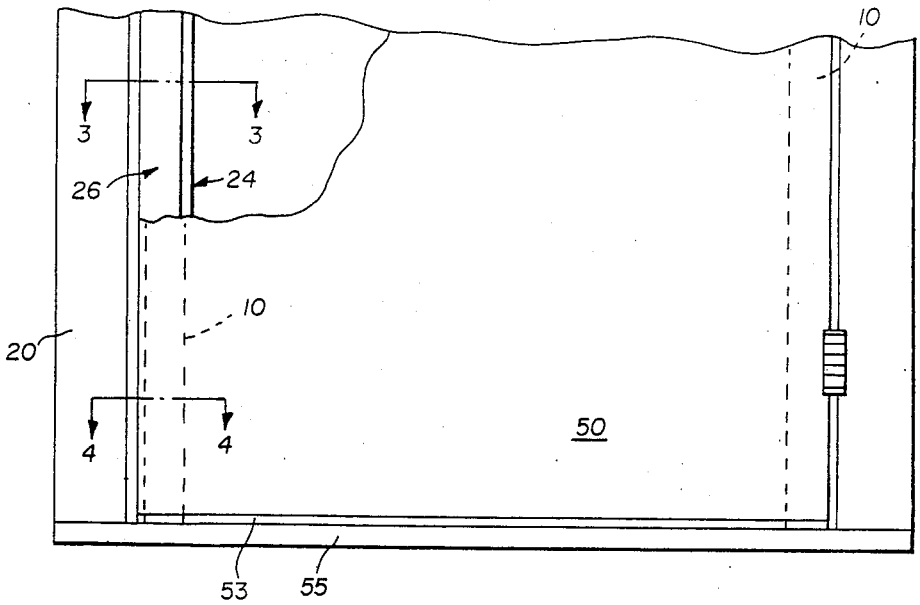
FIG. 2 is a segmental front elevational view of a door and door frame in which the weatherseal is installed, and showing a segmental portion of the door closed, and a segmental portion of the door broken away to show the weatherseal disengaged from the door.
Figure 6:
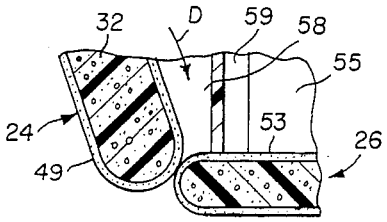
FIG. 6 is a segmental section view taken substantially along line 6—6 of FIG. 5.

Referring now to FIG. 1 of the drawings, a preferred embodiment of the elongate weatherseal 10 of this invention in its manufactured form comprises a substantially rigid, flat, base member 12 formed from any suitable plastic material. A substantially rigid anchoring member 14 is integral with and depends from a side surface 16 of base member 12. Anchoring member 14 has an angled flexible rib 18 which is insertable in a kerf 19 in a support member, such as a door frame 20, for tightly anchoring the weatherseal to the door frame.

(FIGS. 2–5). Other means may be employed other than anchoring member 14, such as adhesive, for example, for anchoring the weatherseal to the support member.

Figure 3:
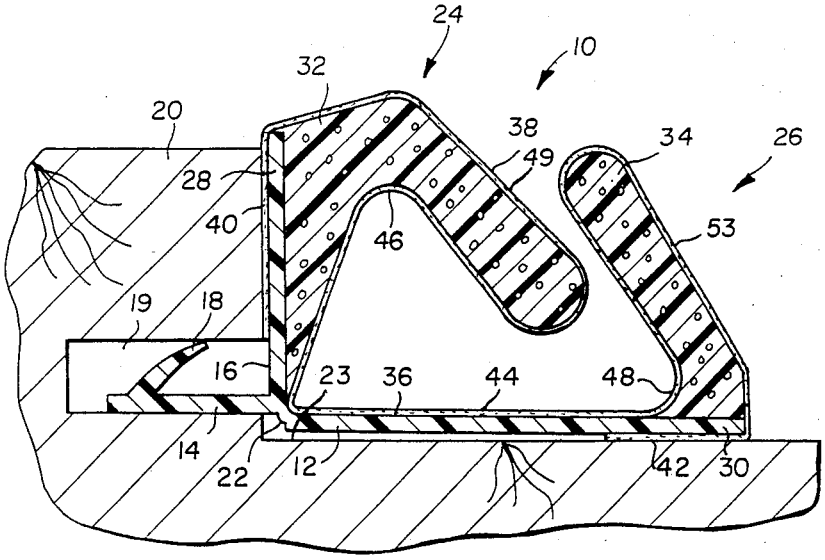
FIG. 3 is a segmental section view taken substantially along line 3—3 of FIG. 2.
Figure 4:
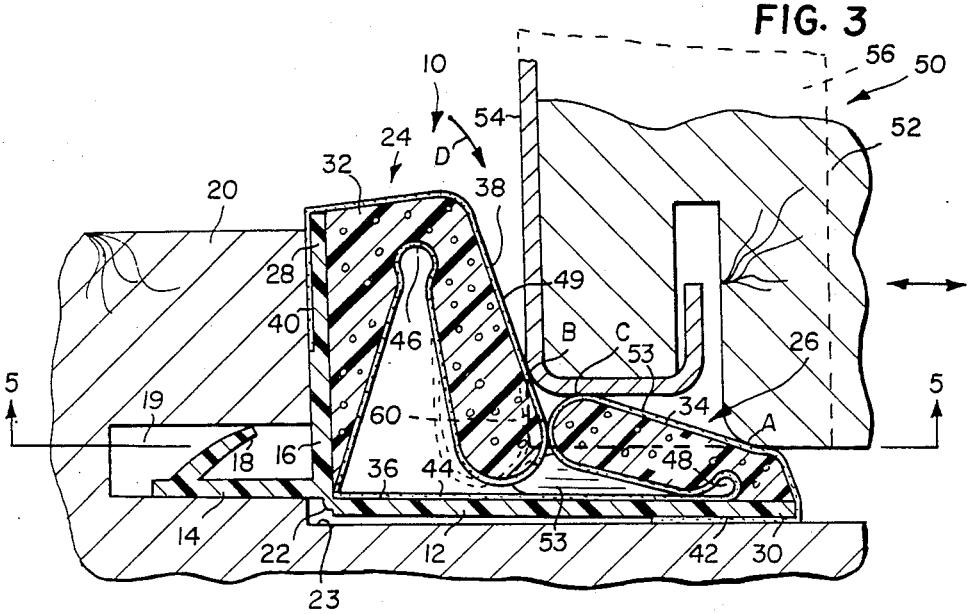
FIG. 4 is a segmental section view taken substantially along line 4—4 of FIG. 2.

Base member 12 is further provided on side surface 16 with a hinge notch 22 at the junction of base member 12 and anchoring member 14. Notch 22 facilitates bending the base member of the weatherseal from its manufactured form through an angle of 90°, as seen in FIGS. 3 and 4, for installation of the weatherseal in a right angled recess 23 in door frame 20.

A pair of legs 24, 26 are secured to opposite side edge portions 28, 30 respectively of base member 12, and extend outwardly toward one-another. Legs 24, 26 comprise cores 32, 34 respectively, formed from any suitable polyurethane foam material secured to side surface 36 of base member 12. Legs 24, 26 are covered with a continuous cover 38 formed from any suitable flexible material, such as polyethylene, for example. The cover 32 has side edge portions, 40, 42 secured to side edge portions 28, 30 respectively, of base member 12. A central portion 44 of cover 38 is secured to a central portion of base member 12. Legs 24, 26 have necked-down portions 46, 48 respectively to facilitate bending of the legs when engaged by a hinged door 50, or the like, as best seen in FIG. 4. Necked-down portion 48 is located substantially at the junction of edge portion 30 and base member 12. Necked-down portion 46 is located between a flat free end portion 49 of leg 24 and a base portion 51 secured to base member 12 for extending end position 49 a predetermined distance from the base member. Leg 26 further has a flat free end portion 53 extending toward end portion 49.

The weatherseal can be manufactured by any suitable process, such as the processes shown in U.S. Pat. Nos. 3,941,543; 3,781,390 and 3,700,368.

Figure 5:
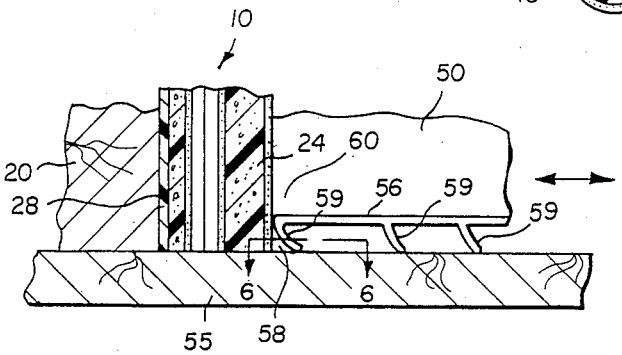
FIG. 5 is a segmental section view taken substantially along line 5—5 of FIG. 4.

With reference to FIGS. 2–5, the weatherseal 10 is shown installed in recess 23 in door frame 20 for sealing the top and vertical side surfaces of door 50. Although the door is shown comprised of a wood stile 52 and exterior metal panel 54, it should be understood that the weatherseal 10 is usable with any type of door as well as in other possible applications, such as windows, for example. The bottom side of door 50 has a conventional weatherstrip 56 secured thereto having flexible fins 59 depending therefrom for sealingly engaging a door sill 55 when the door is closed, as best shown in FIG. 5. When a weatherstrip 56 is used, an air space 58 occurs between the leading bent fin 59 and leg portion 49 which can be a source of air leakage when the door 50 is pressed into sealing engagement with weatherseal 10.

The installation of weatherseal 10 in recess 23 in door frame 20 is achieved by bending the weatherseal from its manufactured form (FIG. 1) around hinge notch 22 through an angle of approximately 90°, and then inserting anchoring member 14 into kerf 19 in door frame 20, as best seen in FIGS. 3 and 4. The angled rib 18 engages the upper kerf surface to hold the weatherseal in its installed position and prevent inadvertent withdrawal therefrom.

The preferred dimensions of weatherseal 10 to satisfactorily achieve the desired sealing interaction between leg portions 49, 53 and the complementary door surfaces involves a base member 12 of a width of about 3.26 cm. The notch 22 is located a distance L′ of about 2 cm from one end of base member 12, and a distance L of about 1.23 cm from the opposite end. Base portion 51 of leg 24 extends from base member 12 a distance of about 0.6 cm. Leg portion 49 extends from base portion 51 a distance of about 1.19 cm at an angle $\alpha$ from the base member of about 35°. Leg portion 53 of leg 26 extends from base member 12 a distance of about 1.19 cm at an angle B from the base member of about 55°.

When door 50 is moved to its closed position, as seen in part in FIGS. 2, 4, 5 and 6, leg portions 49, 53 sealingly engage door 50 along surfaces A, B, and C to prevent cold exterior air from leaking in the direction of arrow D past the door into the warm interior room and vice versa. Particularly, end portion 53 of leg 26 adjacent door sill 55, shown best in FIGS. 4 and 6, sealingly engages side surfaces of door 50 and weatherstrip 56 to prevent cold exterior air passing through air spaces 58 in the direction of arrow D from leaking past leg 24, then around the ends of weatherstrip 56 at the bottom door corners 60, and then into the warm interior room.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. An elongate weatherseal of a generally uniform cross-section throughout its length for installation in a right angled recess in a door frame or the like comprising:

an elongate substantially rigid plastic base member which in its manufactured form is flat and has side edge portions and a central portion;

a pair of legs formed from a soft resilient material, each leg having one end secured to one side surface of said base member at one of said side edge portions thereof, said legs further having opposite flat free end portions extending outwardly transversely of said base member toward one another; and an elongated hinge notch on the opposite side surface of said base member in said central portion of said base member to facilitate bending said base member through an angle of substantially 90° for installation of the weatherseal to the door frame.

2. A weatherseal according to claim 1, and further comprising an elongate substantially rigid attachment member depending from said opposite side surface of said base member adjacent said hinge notch for attaching the weatherseal to the door frame.

3. A weatherseal according to claim 2 wherein said legs are formed of a polyurethane foam material, and further comprise a cover for said legs formed of a polyethylene material.

4. A weatherseal according to claim 3 wherein said cover has side-edge portions and a central portion secured to said side-edge portions and said central portion respectively of said base member.

5. A weatherseal according to claim 4 wherein each of said legs has a necked-down portion adjacent said base member about which said legs are pivotal.

6. A weatherseal according to claim 5 for use in sealing top and vertical sides of a door to the door frame, said door having a wood stile an exterior steel panel, and a framed weatherstrip secured to a bottom side surface of said door, and said wood frame further has a kerf wherein said attachment member is inserted into said kerf for securing said weatherseal to said door frame whereby when said door is moved into its closed position, said steel panel and finned weatherstrip sealingly engage both of said legs to prevent exterior cold air from passing between said wood frame and said top and vertical sides of said door, and said wood stile sealingly engages one of said legs to prevent interior warm air from passing between said wood stile and said door frame and engaging said cold steel panel and condensing.

7. A weatherseal according to claim 6 wherein one of said legs has a base portion secured to said base member, said one leg further having a flat free end portion extending from said base portion at an angle $\alpha$ relative to the base member of about 35°, and said other leg has a flat free end portion extending from said base member at an angle $\beta$ of about 55°.

* * * * *